US007387110B2

(12) United States Patent
Magel

(10) Patent No.: US 7,387,110 B2
(45) Date of Patent: Jun. 17, 2008

(54) COMMON RAIL INJECTOR

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/593,956

(22) PCT Filed: Jan. 19, 2005

(86) PCT No.: PCT/EP2005/050224

§ 371 (c)(1),
(2), (4) Date: Sep. 22, 2006

(87) PCT Pub. No.: WO2005/095788

PCT Pub. Date: Oct. 13, 2005

(65) Prior Publication Data

US 2007/0221177 A1 Sep. 27, 2007

(30) Foreign Application Priority Data

Mar. 31, 2004 (DE) ..... 10 2004 015 744

(51) Int. Cl.
*F02M 37/04* (2006.01)
*F02M 37/08* (2006.01)

(52) U.S. Cl. ..... 123/498; 123/467; 123/446

(58) Field of Classification Search ..... 123/498, 123/446, 447, 467; 239/88, 89, 533.2, 585.5, 239/102.2, 533.3
See application file for complete search history.

(56) References Cited

U.S. PATENT DOCUMENTS

| | | | | |
|---|---|---|---|---|
| 5,152,271 | A | 10/1992 | Matsumura | |
| 6,420,817 | B1 | 7/2002 | Ricci-Ottati et al. | |
| 6,698,711 | B2 * | 3/2004 | Mattes | 251/57 |
| 6,899,069 | B2 * | 5/2005 | Mattes et al. | 123/90.12 |
| 2003/0062026 | A1 * | 4/2003 | Boecking | 123/446 |
| 2003/0098428 | A1 * | 5/2003 | Mattes | 251/57 |
| 2004/0050954 | A1 | 3/2004 | Yamada et al. | |
| 2004/0069963 | A1 * | 4/2004 | Mattes et al. | 251/57 |
| 2004/0154562 | A1 * | 8/2004 | Mattes et al. | 123/90.11 |
| 2007/0007362 | A1 * | 1/2007 | Sturman | 239/88 |

FOREIGN PATENT DOCUMENTS

| | | |
|---|---|---|
| DE | 102 45 135 A1 | 4/2003 |
| DE | 103 33 696 A1 | 2/2005 |
| EP | 1 388 666 A1 | 2/2004 |
| WO | 03/064848 A1 | 8/2003 |
| WO | WO 2005/010342 A1 | 2/2005 |

* cited by examiner

*Primary Examiner*—Mahmoud Gimie
(74) *Attorney, Agent, or Firm*—Ronald E. Greigg

(57) ABSTRACT

A common rail injector having an injector housing having a fuel supply line which communicates with a central high-pressure fuel source outside the injector housing and with a pressure chamber inside the injector housing, from which pressure chamber, as a function of the position of a 3/2-way control valve, fuel subjected to high pressure is injected. The 3/2 way control valve, includes a valve piston, movable back and forth in the injector housing between a position of repose and an injection position, which piston is coupled hydraulically with a piezoelectric actuator that is subjected to the pressure from the high-pressure fuel source.

17 Claims, 2 Drawing Sheets

COMMON RAIL INJECTOR

CROSS-REFERENCE TO RELATED APPLICATIONS

This application is a 35 USC 371 application of PCT/EP 2005/050224filed on Jan. 19, 2005.

BACKGROUND OF THE INVENTION

1. Field of the Invention

The invention relates to a common rail injector for injecting fuel into a combustion chamber of an internal combustion engine, having an injector housing, which has a fuel supply line which communicates with a central high-pressure fuel source outside the injector housing and with a pressure chamber inside the injector housing, from which pressure chamber, as a function of the position of a control valve, especially a 3/2-way valve, fuel subjected to high pressure is injected.

2. Prior Art

From German Published Patent Application DE 102 29 415 A1, a pressure-boosted fuel injector is known, which is supplied with fuel at high pressure via a high-pressure reservoir. From the interior of the high-pressure reservoir, a supply line leads to a pressure booster, which is integrated into the fuel injector. The pressure booster is enclosed by an injector body of the fuel injector. The fuel injector further includes a metering valve, which is embodied as a 3/2-way valve. The metering valve can be embodied as a solenoid or can be actuated via a piezoelectric actuator. The metering valve can also be embodied as a servo valve or as a direct-switching valve. The control of known common rail injectors is usually done with servo valves or solenoids, which are expensive and tolerance-sensitive.

The object of the invention is to create a common rail injector for injecting fuel into a combustion chamber of an internal combustion engine, having an injector housing, which has a fuel supply line which communicates with a central high-pressure fuel source outside the injector housing and with a pressure chamber inside the injector housing, from which pressure chamber, as a function of the position of a control valve, especially a 3/2-way valve, fuel subjected to high pressure is injected, which can be produced inexpensively and also functions reliably even at high pressures.

SUMMARY OF THE INVENTION

In a common rail injector for injecting fuel into a combustion chamber of an internal combustion engine, having an injector housing, which has a fuel supply line which communicates with a central high-pressure fuel source outside the injector housing and with a pressure chamber inside the injector housing, from which pressure chamber, as a function of the position of a control valve, especially a 3/2-way valve, fuel subjected to high pressure is injected, this object is attained in that the control valve, in particular the 3/2-way valve, includes a valve piston, movable back and forth in the injector housing between a position of repose and an injection position, which piston is coupled hydraulically with a piezoelectric actuator that is subjected to the pressure from the high-pressure fuel source. The piezoelectric actuator is subjected to pressure both axially and radially, or in other words transversely. The piezoelectric actuator serves to actuate the valve piston. With the omission of the control quantity that occurs in servo valves, the efficiency of the injector is improved. The requisite axial prestressing force for the piezoelectric actuator is generated hydraulically, at least in part. As a result, no major spring forces have to be implemented in the injector, which has advantages in terms of installation space and expense. Because of the very fast switching speed of the valve with a piezoelectric actuator, the tolerance performance of the injector can be improved. Moreover, the minimal-quantity capability (preinjection quantities) is assured.

A preferred exemplary embodiment of the common rail injector is characterized in that the injector housing includes a hydraulic coupling chamber, subjected to the pressure from the high-pressure fuel reservoir, by way of which coupling chamber the piezoelectric actuator is coupled hydraulically with the valve piston. A substantially circular-cylindrical head of metal can for instance be mounted on the piezoelectric actuator and its end face defines the hydraulic coupling chamber. On the diametrically opposite side, the hydraulic coupling chamber is preferably defined by a face end of the valve piston. The hydraulic coupling chamber serves to compensate for expansions in volume of the piezoelectric actuator that are caused by temperature fluctuations in operation. In addition, a force/travel boost can be implemented as a result between the piezoelectric actuator and the valve piston.

A further preferred exemplary embodiment of the common rail injector is characterized in that a first end of the valve piston defines the hydraulic coupling chamber, and a second end of the valve piston protrudes into a valve control chamber, which in the injection position of the valve piston is in communication with a fuel return and which in the position of repose of the valve piston is subjected to the pressure from the high-pressure fuel reservoir. The fuel return can communicate for instance with a fuel tank and makes a fast pressure reduction in the valve control chamber possible. In the position of repose of the valve piston, the injector is filled with fuel, at least partly, via the valve control chamber.

A further preferred exemplary embodiment of the common rail injector is characterized in that a first sealing edge, which in the position of repose of the valve piston interrupts a communication between the valve control chamber and the fuel return, and a second sealing edge, which in the injection position of the valve piston interrupts a communication between the high-pressure fuel reservoir and the valve control chamber, are embodied on the valve piston. In the position of repose of the valve piston, the injector is not activated; that is, no injection takes place. In the injection position of the valve piston, fuel subjected to high pressure is injected from the injector into the combustion chamber of an internal combustion engine.

A further preferred exemplary embodiment of the common rail injector is characterized in that a valve piston guide portion, whose diameter is somewhat less than the diameter of the first sealing edge, is embodied on the first end of the valve piston. As a result, in the position of repose of the valve piston, a slight hydraulic pressing force is generated, which assures a tight contact of the first sealing edge with its associated valve seat, which seat may be provided on the injector housing.

A further preferred exemplary embodiment of the common rail injector is characterized in that the diameter of the second sealing edge is somewhat less than the diameter of the valve piston guide portion. As a result, in the position of repose of the valve piston, a slight hydraulic pressing force is generated, which assures a tight contact of the second sealing edge with its associated valve seat, which seat may be provided on the injector housing.

A further preferred exemplary embodiment of the common rail injector is characterized in that the valve piston is embodied in one piece. The one-piece version has the advantage that both sealing edges can be guided by the valve piston guide portion.

A further preferred exemplary embodiment of the common rail injector is characterized in that the valve piston is embodied in multiple parts, in particular in two parts. The multi-part version offers advantages in terms of production, especially in conjunction with a multi-part valve body.

A further preferred exemplary embodiment of the common rail injector is characterized in that the valve control chamber communicates with a valve member control chamber. As the valve member, nozzle needles whose tip is pressed against a suitably embodied nozzle needle seat with the aid of a prestressed nozzle spring are preferably used. If the pressure in the valve control chamber is reduced via the 3/2-way valve, the tip of the nozzle needle lifts away from its seat, and fuel is injected through injection ports into the combustion chamber of the engine.

A further preferred exemplary embodiment of the common rail injector is characterized in that the valve control chamber is in communication with a pressure booster control chamber. The pressure booster control chamber serves to control a pressure booster piston, which may be received, in a way capable of moving back and forth, in the injector housing.

BRIEF DESCRIPTION OF THE DRAWINGS

Further advantages, characteristics and details of the invention will become apparent from the ensuing description of various exemplary embodiments, taken in conjunction with the drawings, in which.

DESCRIPTION OF THE PREFERRED EMBODIMENTS

Figure 1:
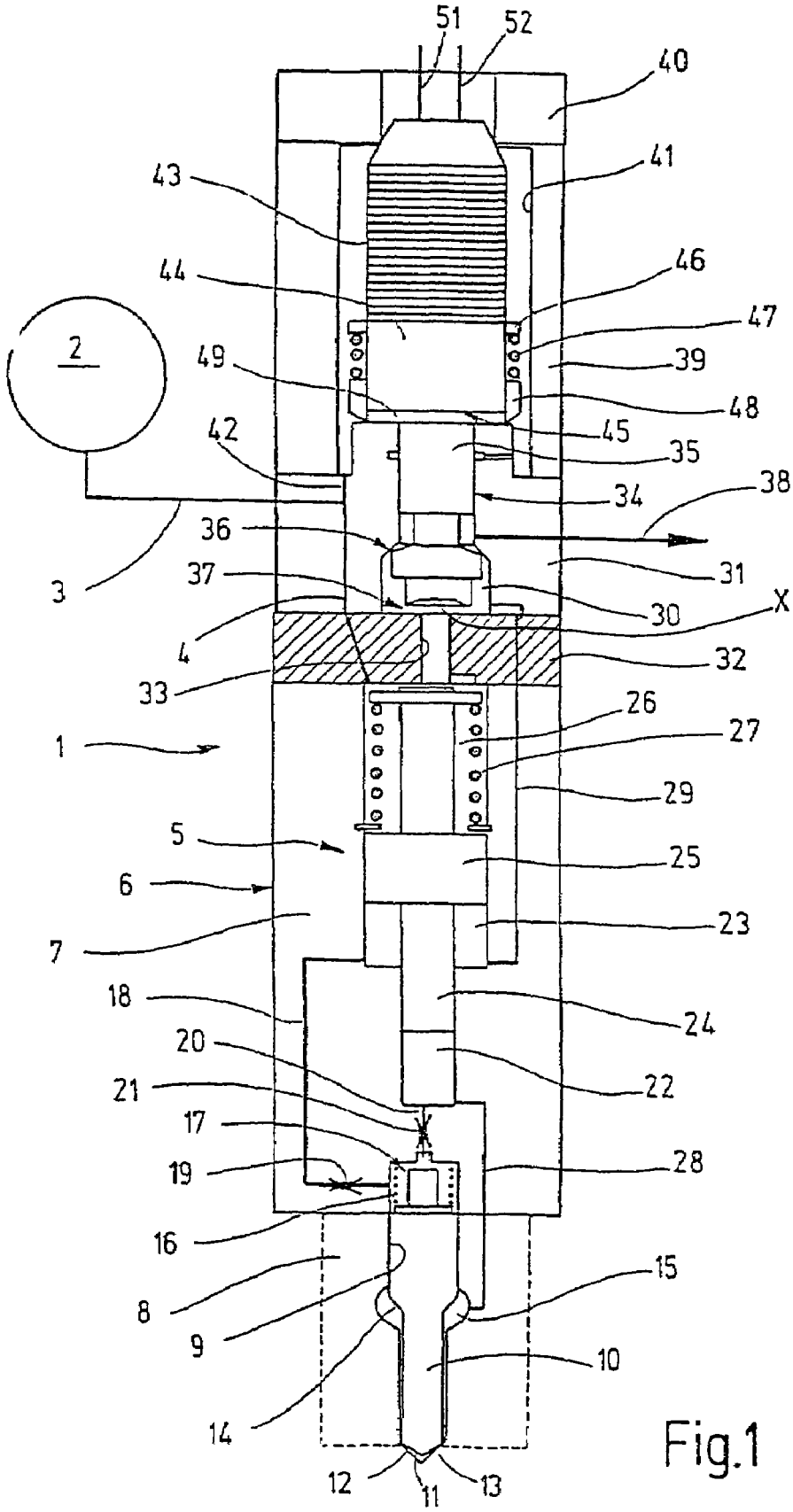
FIG. 1, shows a first exemplary embodiment in longitudinal section through the injector, with a pressure booster.

In FIG. 1, a longitudinal section is shown through a common rail injector 1, which is supplied with fuel that is at high pressure via a high-pressure reservoir 2 (common rail) shown only schematically. From the interior of the high-pressure reservoir 2, a fuel supply line 3, 4 extends to a pressure booster 5, which is integrated into the fuel injector 1. The pressure booster 5 is enclosed by an injector housing 6.

The injector housing 6 includes an injector body 7 and a nozzle body 8, which has a central guide bore 9. A nozzle needle 10 is guided movably back and forth in the guide bore 9. The nozzle needle 10 has a tip 11, on which a pressure face is embodied that cooperates with a sealing seat that is embodied on the nozzle body 8. When the tip 11 of the nozzle needle 10, with its pressure face, is in contact with the sealing seat, a plurality of injection ports 12, 13 in the nozzle body 8 are closed. When the nozzle needle tip 11 lifts from its seat, fuel subjected to high pressure is injected through the injection ports 12, 13 into the combustion chamber of the engine.

A pressure shoulder 14 is embodied on the nozzle needle 10 and is located in a pressure chamber 15 in the nozzle body 8. The nozzle needle 10 is prestressed with its tip 11 against the associated nozzle needle seat by a nozzle spring 16. The nozzle spring 16 is received in a nozzle spring chamber 17 that is recessed out of the injector body 7. The nozzle spring chamber 17 communicates, via a connecting conduit 18 in which a throttle restriction 19 is located, with a pressure booster control chamber 23. Moreover, the nozzle spring chamber 17 communicates, via a connecting conduit 20 in which a throttle restriction 21 is provided, with a pressure booster chamber 22.

The pressure booster chamber 22 is formed by a portion of a central bore in the injector body 7, in which one end 24 of a pressure booster piston 25 is received, in a way capable of moving back and forth. The end 24 of the pressure booster piston 25 takes the form of a circular cylinder, which has a smaller diameter than the adjoining part of the pressure booster piston 25. The other end of the pressure booster piston 25 protrudes into a pressure booster work chamber 26, which is in communication with the high-pressure fuel reservoir 2 via the fuel supply line 3, 4. A pressure booster spring 27 is located in the pressure booster work chamber 26, and with the aid of this spring the pressure booster piston 25 is prestressed in the direction away from the nozzle needle 10.

The pressure booster chamber 22 is in communication with the pressure chamber 15 in the nozzle body 8, via a connecting conduit 28. The pressure booster control chamber 23 is in communication, via a connecting conduit 29, with a valve control chamber 30 that is recessed out of a valve body 31. Between the valve body 31 and the injector body 7, there is an intermediate piece 32, from which a central connecting conduit 33 is recessed out. The connecting conduit 33 creates a communication between the pressure booster work chamber 26 and the valve control chamber 30.

The valve control chamber 30 is formed by a portion of a central bore that is recessed out of the valve body 31. The valve control chamber 30 has a larger diameter than the portion of the bore facing away from the intermediate piece 32. A valve piston 34 is received, capable of moving back and forth, in the central bore of the valve body 31. The valve piston 34 has a valve piston guide portion 35, which is guided in the central bore of the valve body 31. On the end of the valve piston 31 facing away from the valve piston guide portion 35, a first sealing edge 36 is embodied, which rests on a sealing seat that is embodied on the valve body 31. On the face end of the valve piston 34 facing away from the valve piston guide portion 35, a second sealing edge 37 is embodied, which can come into contact with the intermediate piece 32. Between the valve piston guide portion 35 and the first sealing edge 36, a return conduit 38 is provided in the valve body 31 and is in communication with a fuel tank (not shown).

The valve body 31 is adjoined by a piezoelectric actuator body 39, which is closed by a cap 40. The cap 40, piezoelectric actuator body 39, valve body 31, intermediate piece 32, injector body 7, and nozzle body 8 together form the injector housing 6. In the piezoelectric actuator body 39, a central piezoelectric actuator chamber 41 is recessed out, which chamber is in communication, via a connecting conduit 42, with the fuel supply line 3 and thus with the high-pressure reservoir 2. In the piezoelectric actuator chamber 41, which is subjected to high pressure, there is a piezoelectric actuator 43, which has a piezoelectric actuator head 44 of metal, with a free face end 45. A collar 46 is embodied on the piezoelectric actuator head 44. A piezoelectric actuator spring 47 is fastened between the collar 46 and a piezoelectric actuator sleeve 48. The piezoelectric actuator head 44 is displaceable axially relative to the piezoelectric actuator sleeve 48. A sealing edge that rests on the valve body 31 is embodied on the piezoelectric actuator sleeve 48. In the interior of the piezoelectric actuator sleeve 48, a hydraulic coupling chamber 49 is embodied between the face end 45 of the piezoelectric actuator head 44 and the free face end of the guide portion 35 of the valve piston 34, and this chamber is subjected to high pressure from the high-pressure reservoir 2.

In FIG. 1, the common rail injector 1 is shown in its deactivated state. The valve piston 34 is in its position of repose. The first sealing edge 36 is then in contact with the associated sealing seat, which is embodied on the valve body 31. Rail pressure prevails in the hydraulic coupling chamber 49. This is assured by a suitable design of the sealing gap. In the guide region of the two pistons, the components are embodied such that they are subjected two high pressure from outside as well. As a result, a widening of the sealing gap by the coupler chamber pressure, which would impair the function, is averted. Alternatively, the filling of the coupling chamber 49 could also be done by means of a suitably small throttle restriction. The valve control chamber 30, via the fuel supply lines 3, 4, the pressure booster work chamber 26, and the connecting conduit 33, is likewise subjected to the rail pressure from the high-pressure reservoir 2. The pressure booster control chamber 23 is likewise subjected to the rail pressure, via the connecting conduit 29. Rail pressure likewise prevails in the pressure booster chamber 22, the nozzle spring filter chamber 17, and the pressure chamber 15.

For activation of the common rail injector 1, the piezoelectric actuator 43 is supplied with current via electric leads 51, 52 and expands. The expansion of the piezoelectric actuator 43 leads, via the piezoelectric actuator head 44, to a pressure increase in the hydraulic coupling chamber 49. This pressure increase causes an axial motion of the valve piston 34 downward, or in other words toward the nozzle needle 10. The valve piston 34 moves downward until such time as the second sealing edge 37 comes into contact with the intermediate piece 32 and interrupts the communication between the connecting conduit 33 and the valve control chamber 30. Simultaneously, the first sealing edge 36 lifts from its sealing seat on the valve body 31 and opens a communication with the valve control chamber 30 and the return conduit 38. The valve piston 34 is then in its injection position (not shown). Because of the communication with the return conduit 38, the valve control chamber 30 is pressure-relieved. Via the connecting conduit 29 between the valve control chamber 30 and the pressure booster control chamber 23, the latter control chamber is likewise pressure-relieved. Since the pressure booster work chamber 26, via the fuel supply lines 3, 4, is, as before, still subjected to the rail pressure from the high-pressure reservoir 2, the pressure booster piston 25 moves downward, or in words toward the nozzle needle 10, and as a result the fuel in the pressure booster chamber 22 is compressed. This pressure increase is also operative in the pressure chamber 15, via the connecting conduit 28. This in turn causes the nozzle needle 10 to lift from its seat and causes fuel to be injected.

Because of the optimized structural design with the piezoelectric actuator 43 in the rail pressure, with the rail pressure in the hydraulic coupling chamber 49 and suitable pressure faces on the valve piston 34, a very simple, economical overall construction is achieved. The requisite axial prestressing force for the piezoelectric actuator 43 is generated primarily hydraulically. The 3/2-way valve piston 34 is controlled directly by the piezoelectric actuator 43. The hydraulic coupling chamber 49 is provided to compensate for temperature expansions and for force/travel boosting. The valve piston 34 is embodied as virtually completely pressure-balanced. This is achieved by embodying a pressure face X on the valve piston that is subjected constantly to high pressure from the injector supply line. As a result, only a small actuator force is needed to move the valve, and a small, less-expensive piezoelectric actuator can be used. The valve construction with the valve body 31 and the intermediate piece 32, in combination with the one-piece valve piston 34 with a flat seat, makes manufacturing it simple.

The valve piston 34 may also be embodied as completely pressure-balanced. In that case, the requisite closing forces for assuring the tightness of the valve seats are furnished by prestressed springs, or by the actuator.

The valve piston 34 may also be embodied as a multi-part piston combination; in that case, the two control edges are located in one component, and the piston portion that defines the coupling chamber is located in a further component. As a result, the valve body can also be embodied in multiple parts. This offers advantages when very small valve geometries are being produced.

Figure 2:
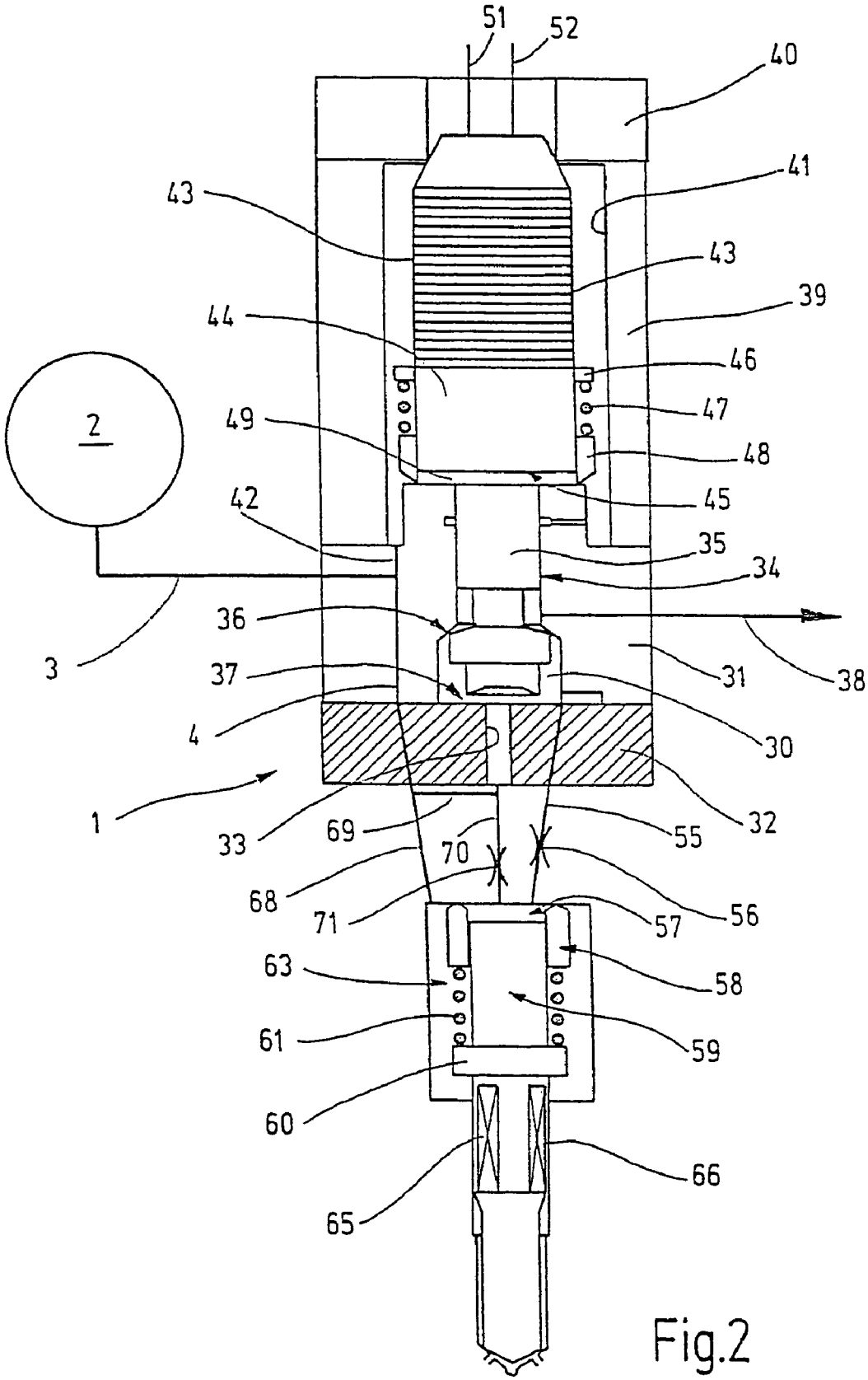
FIG. 2, shows a second exemplary embodiment in longitudinal section through the injector, without a pressure booster.

In FIG. 2, a common rail injector 1 is shown without a pressure booster. The common rail injector 1 shown in FIG. 2 includes the same piezoelectric actuator body, the same injector body, and the same intermediate piece as the common rail injector shown in FIG. 1. Identical parts are identified by the same reference numerals. To avoid repetition, reference is made to the above description of FIG. 1. Below, only the differences between the two embodiments will be addressed.

In the common rail injector 1 shown in FIG. 2, the valve control chamber 30 is in communication, via a connecting conduit 55 in which a throttle restriction 56 is embodied, with a nozzle needle control chamber 57. The nozzle needle control chamber 57 is located inside a sealing sleeve 58, which is equipped with a bite edge. The nozzle needle control chamber 57 is also defined by one face end of a nozzle needle 59. A collar 60 is embodied on the nozzle needle 59. Between the collar 60 and the sealing sleeve 58, a spring 61 is prestressed in such a way that the bite edge of the sealing sleeve 58 is pressed against the injector housing. On the other end, the nozzle needle 59 is kept with its tip in contact with the associated nozzle needle seat, because of the prestressing force of the spring 61. A pressure chamber 63 is in communication with the tip of the nozzle needle, via flat faces 65, 66. Moreover, the pressure chamber 63 communicates with the high-pressure reservoir 2 via a connecting conduit 68 and the fuel supply lines 3, 4. The connecting conduit 68 is in communication with the nozzle needle control chamber 57 via a connecting conduit 69 and a connecting conduit 70 in which a throttle restriction 71 is located.

The common rail injector 1 shown in FIG. 2 is in the deactivated state. The first sealing edge 36 is closed, and the second sealing edge 37 is open. Rail pressure prevails in the coupling chamber 49. The valve control chamber 30, the nozzle needle control chamber 57, and the pressure chamber 63 are likewise at rail pressure. The valve piston 34 is in its position of repose.

For activating the common rail injector 1 shown in FIG. 2, the piezoelectric actuator 43 is supplied with current and expands. This causes a pressure increase in the hydraulic coupling chamber 49 and as a result a motion of the valve piston 34 downward. In the process, the first sealing edge 36 opens and the second sealing edge 37 closes, so that a communication is opened between the valve control chamber 30 and the return 38. As a result, the valve control chamber 30 is pressure-relieved. This pressure relief also has an effect, via the connecting conduit 55, in the nozzle needle control chamber 57, so that the nozzle needle 59 lifts with its tip from the associated seat, and as a result fuel is injected into the combustion chamber of the engine.

The foregoing relates to a preferred exemplary embodiment of the invention, it being understood that other variants and embodiments thereof are possible within the spirit and scope of the invention, the latter being defined by the appended claims.

The invention claimed is:

1. A common rail injector for injecting fuel into a combustion chamber of an internal combustion engine, having an injector housing including a fuel supply line communicating with a central high-pressure fuel source outside the injector housing and with a pressure chamber inside the injector housing, from which pressure chamber, as a function of the position of a 3/2-way control valve, fuel subjected to high pressure is injected into the combustion chamber, wherein the control valve comprises a valve piston which is movable back and forth in the injector housing between a position of repose and an injection position, wherein the valve piston is coupled hydraulically with a piezoelectric actuator and the valve piston is subjected to the pressure from the high-pressure fuel source, and further comprising a pressure face embodied on the valve piston, the pressure face being subjected constantly to high pressure from the fuel supply line.

2. The common rail injector as defined by claim 1, further comprising a hydraulic coupling chamber subjected to the pressure from a high-pressure fuel reservoir, and wherein the piezoelectric actuator is coupled hydraulically with the valve piston by way of said coupling chamber.

3. The common rail injector as defined by claim 2, further comprising a pressure face embodied on the valve piston, the pressure face being subjected constantly to high pressure from the fuel supply line.

4. The common rail injector as defined by claim 1, wherein a first end of the valve piston defines the hydraulic coupling chamber, and a second end of the valve piston protrudes into a valve control chamber, which control chamber in the injection position of the valve piston is in communication with a fuel return and which in the position of repose of the valve piston is subjected to the pressure from the high-pressure fuel reservoir.

5. The common rail injector as defined by claim 2, wherein a first end of the valve piston defines the hydraulic coupling chamber, and a second end of the valve piston protrudes into a valve control chamber, which control chamber in the injection position of the valve piston is in communication with a fuel return and which in the position of repose of the valve piston is subjected to the pressure from the high-pressure fuel reservoir.

6. The common rail injector as defined by claim 3, wherein a first end of the valve piston defines the hydraulic coupling chamber, and a second end of the valve piston protrudes into a valve control chamber, which control chamber in the injection position of the valve piston is in communication with a fuel return and which in the position of repose of the valve piston is subjected to the pressure from the high-pressure fuel reservoir.

7. The common rail injector as defined by claim 4, further comprising a first sealing edge on the valve piston which interrupts a communication between the valve control chamber and the fuel return when the valve piston is in the position of repose and a second sealing edge on the valve piston which interrupts a communication between the high-pressure fuel reservoir and the valve control chamber in the injection position of the valve piston.

8. The common rail injector as defined by claim 5, further comprising a first sealing edge on the valve piston which interrupts a communication between the valve control chamber and the fuel return when the valve piston is in the position of repose and a second sealing edge on the valve piston which interrupts a communication between the high-pressure fuel reservoir and the valve control chamber in the injection position of the valve piston.

9. The common rail injector as defined by claim 6, further comprising a first sealing edge on the valve piston which interrupts a communication between the valve control chamber and the fuel return when the valve piston is in the position of repose and a second sealing edge on the valve piston which interrupts a communication between the high-pressure fuel reservoir and the valve control chamber in the injection position of the valve piston.

10. The common rail injector as defined by claim 7, further comprising a valve piston guide portion embodied on the first end of the valve piston, the valve piston guide portion having a diameter smaller than the diameter of the first sealing edge.

11. The common rail injector as defined by claim 10, wherein the diameter of the second sealing edge is smaller than the diameter of the valve piston guide portion.

12. The common rail injector as defined by claim 10, wherein the valve piston is embodied in one piece.

13. The common rail injector as defined by claim 11, wherein the valve piston is embodied in one piece.

14. The common rail injector as defined by claim 11, wherein the valve piston is embodied in two parts.

15. The common rail injector as defined by claim 12, wherein the valve piston is embodied in two parts.

16. The common rail injector as defined by claim 1, wherein the valve control chamber communicates with a valve member control chamber.

17. The common rail injector as defined by claim 1, wherein the valve control chamber is in communication with a pressure booster control chamber.

* * * * *